US009160094B2

(12) United States Patent
Yamada et al.

(10) Patent No.: US 9,160,094 B2
(45) Date of Patent: Oct. 13, 2015

(54) WIRE ARRAY RUBBER CONNECTOR AND METHOD FOR PRODUCING THE SAME

(75) Inventors: Shinji Yamada, Aichi (JP); Takumi Kataishi, Aichi (JP); Toshiki Ogawa, Aichi (JP)

(73) Assignee: Fuji Polymer Industries Co., Ltd., Aichi (JP)

( * ) Notice: Subject to any disclaimer, the term of this patent is extended or adjusted under 35 U.S.C. 154(b) by 150 days.

(21) Appl. No.: 13/521,369

(22) PCT Filed: Nov. 15, 2011

(86) PCT No.: PCT/JP2011/076240

§ 371 (c)(1),
(2), (4) Date: Jul. 10, 2012

(87) PCT Pub. No.: WO2012/132092

PCT Pub. Date: Oct. 4, 2012

(65) Prior Publication Data

US 2012/0322315 A1 Dec. 20, 2012

(30) Foreign Application Priority Data

Mar. 25, 2011 (JP) ..... 2011-067142

(51) Int. Cl.

| | |
|---|---|
| ***H01R 4/58*** | (2006.01) |
| ***H01R 13/24*** | (2006.01) |
| ***H01R 43/00*** | (2006.01) |
| ***H01R 43/24*** | (2006.01) |
| *H01R 13/527* | (2006.01) |

(52) U.S. Cl.

CPC ..... *H01R 13/2414* (2013.01); *H01R 43/005* (2013.01); *H01R 43/24* (2013.01); *H01R 13/527* (2013.01)

(58) Field of Classification Search

CPC ..... H01R 13/2414

USPC ..... 439/91, 66; 428/295.1

See application file for complete search history.

(56) References Cited

U.S. PATENT DOCUMENTS 4,449,774 A * 5/1984 Takashi et al. ..... 439/590
5,909,123 A * 6/1999 Budnaitis ..... 324/750.05

(Continued)

FOREIGN PATENT DOCUMENTS

CN 101599314 12/2009
JP 55-111014 8/1980

(Continued)

*Primary Examiner* — Phuong Dinh

(74) *Attorney, Agent, or Firm* — Hamre, Schumann, Mueller & Larson, P.C.

(57) ABSTRACT

Disclosed is a wire array rubber connector (10), including: an electrical insulating rubber (2); and a plurality of conductive metal wires (1) that are arrayed in a thickness direction of the electrical insulating rubber so as to pass through front and back surfaces of the electrical insulating rubber, and localized so as to be electrically connectable to electrical terminals that are disposed at predetermined positions on the front and back surfaces of the electrical insulating rubber. The electrical insulating rubber (2) is a flame-resistant rubber achieving V-0 based on the UL-94 standard. This wire array rubber connector (10) is obtained by: mixing a plurality of conductive metal wires having a predetermined length into a liquid thermosetting electrical insulating rubber material; applying a magnetic field from a thickness direction of the rubber material using an electromagnet that is patterned in a predetermined pattern so that the conductive metal wires are arrayed in the thickness direction and localized; and curing the rubber material by heating, thereby providing the wire array rubber connector with high flame resistance and with low transmission loss in a high frequency region.

9 Claims, 5 Drawing Sheets

(56) References Cited

U.S. PATENT DOCUMENTS

| | | | | |
|---|---|---|---|---|
| 6,011,307 | A | 1/2000 | Jiang et al. | |
| 7,022,404 | B2 * | 4/2006 | Sethumadhavan et al. | 428/295.1 |
| 7,629,063 | B2 | 12/2009 | Yamamoto et al. | |
| 2003/0216068 | A1 * | 11/2003 | Weiss | 439/91 |
| 2005/0095884 | A1 * | 5/2005 | Brodsky et al. | 439/91 |
| 2008/0234412 | A1 | 9/2008 | Yamamoto et al. | |

FOREIGN PATENT DOCUMENTS

| | | | |
|---|---|---|---|
| JP | 59-58709 | | 4/1984 |
| JP | 61-211969 | | 9/1986 |
| JP | 01-122506 | | 5/1989 |
| JP | 01-213915 | | 8/1989 |
| JP | 05-62727 | | 3/1993 |
| JP | 3004790 | U | 9/1994 |
| JP | 11-49959 | | 2/1999 |
| JP | 2001-322139 | | 11/2001 |
| JP | 2005-116380 | | 4/2005 |
| JP | 2005-235509 | | 9/2005 |
| JP | 2005-236219 | | 9/2005 |
| JP | 2006-49067 | | 2/2006 |
| JP | 2007-099800 | | 4/2007 |
| JP | 2009-129609 | | 6/2009 |
| JP | 2011-44329 | | 3/2011 |
| JP | 5042498 | B | 10/2012 |
| TW | 1346124 | | 8/2011 |

* cited by examiner

WIRE ARRAY RUBBER CONNECTOR AND METHOD FOR PRODUCING THE SAME

TECHNICAL FIELD

The present invention relates to a wire array rubber connector in which metal wires are arrayed in a rubber member in one direction, and a method for producing the same.

BACKGROUND ART

Rubber connectors have been used conventionally for electrically connecting printed circuit boards, a printed circuit board and another electronic component, or the like. Examples of known rubber connectors include: a type in which a conductive rubber and an electrical insulating rubber are laminated; a type in which conductive particles are arrayed in an electrical insulating rubber by applying a magnetic field; and a type in which conductive metal wires are arrayed in an electrical insulating rubber by applying a magnetic field. Among these, the lamination type has a problem of high electric resistance due to the use of carbon particles in the conductive rubber. Further, the type in which conductive particles are arrayed includes areas where the conductive particles are connected imperfectly, which causes a problem in conduction stability. Meanwhile, the type in which conductive metal wires are arrayed is highly advantageous in conduction stability. This type of connector has been proposed in Patent Document 1, for example.

However, since the connector proposed in Patent Document 1 has no or low flame resistance, the development of high flame-resistant connectors has been demanded. Additionally, the development of connectors with low transmission loss in a high frequency region also has been demanded. For example, a conventional hard disk connector shown in FIG. 4 has a thickness of 3.2 mm, and the transmission loss thereof is 5-8 dB at a frequency of 6 GHz.

PRIOR ART DOCUMENT

Patent Document

Patent Document 1: JP 05(1993)-062727 A

DISCLOSURE OF INVENTION

Problem to be Solved by the Invention

In order to solve the above conventional problem, the present invention provides a wire array rubber connector with high flame resistance and with low transmission loss in a high frequency region, and a method for producing the same.

Means for Solving Problem

A wire array rubber connector of the present invention includes: an electrical insulating rubber; and a plurality of conductive metal wires that are arrayed in a thickness direction of the electrical insulating rubber so as to pass through front and back surfaces of the electrical insulating rubber, and localized so as to be electrically connectable to electrical terminals that are disposed at predetermined positions on the front and back surfaces of the electrical insulating rubber. The electrical insulating rubber is a flame-resistant rubber achieving V-0 based on the UL-94 standard.

A method for producing a wire array rubber connector of the present invention includes: mixing a plurality of conductive metal wires having a predetermined length into a liquid thermosetting electrical insulating rubber material; applying a magnetic field from a thickness direction of the rubber material using an electromagnet that is patterned in a predetermined pattern so that the conductive metal wires are arrayed in the thickness direction and localized; and curing the rubber material in this state by heating, thereby producing the above-described wire array rubber connector.

Effect of the Invention

Since the electrical insulating rubber used for the wire array rubber connector of the present invention is a flame-resistant rubber achieving V-0 based on the UL-94 standard, the flame resistance of the connector can be high. Further, since the length of the conductive wire can be shortened, the transmission loss of the connector in a high frequency region can be low.

DESCRIPTION OF THE INVENTION

Figure 1A:
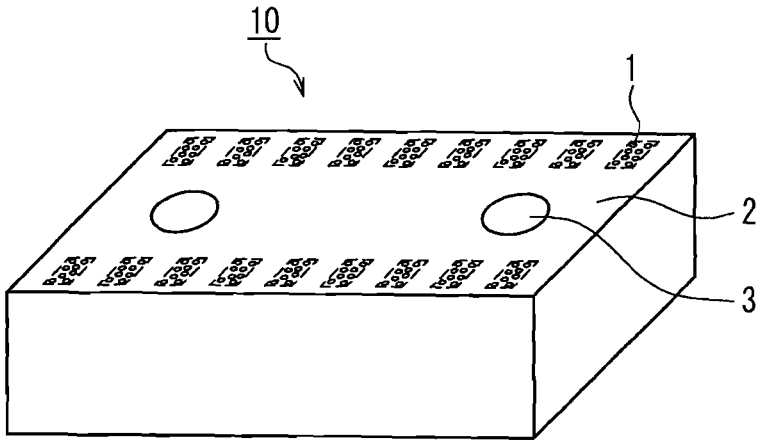
FIG. 1A is a perspective view of a connector in one example of the present invention.

An electrical insulating rubber is used for the connector of the present invention. The flame-resistant level thereof is V-0 based on the UL-94 standard. The UL standard is an international standard determined by Underwriters Laboratories of the U.S.A. The V-0 test method is as follows: using a vertical burning test, flame is applied using a gas burner for 10 seconds to lower ends of specimens held vertically. If the burning ceases within 30 seconds, flame is applied again for another 10 seconds. For the judgment of V-0, all of the following criteria should be satisfied:

(1) No specimen burns for more than 10 seconds after both of the flame applications.
(2) A total burning time does not exceed 50 seconds for 10 flame applications for each set of 5 specimens.
(3) No specimen burns up to a position of a fixing clamp.
(4) No specimen drips burning particles that ignite an absorbent cotton piece placed below the specimen.
(5) No specimen glows for more than 30 seconds after the second flame application.

An example of the electrical insulating rubber achieving V-0 based on the above-described UL-94 standard is urethane rubber, specifically, "MU-204A/B", "XU-19662" and "XU- 19663" (trade names) produced by Pelnox, Ltd. It is preferable to use these urethane rubbers also in the present invention.

In addition to its high flame resistance, the merit of using the urethane rubber achieving V-0 based on the UL-94 standard is that substances (e.g., oligomer) do not fall off during use. Although silicone rubber has high heat resistance, there is concern about falling substances (e.g., oligomer) during use. Such falling substances may adversely affect electronic devices such as a hard disk device. Additionally, by utilizing the elasticity of urethane rubber, the connector can be incorporated into an electronic device by press fitting.

In the connector of the present invention, a plurality of conductive metal wires are arrayed in the thickness direction of the rubber so as to pass through front and back surfaces of the rubber, and localized at positions to be electrically connectable to electrical terminals. Thereby, electricity flows only in the thickness direction of the rubber and does not flow in the other directions. Therefore, such a connector is known also as an anisotropically conductive rubber connector. It is preferable that metal wires are not present in a portion not used for electrical connection.

The connector of the present invention can be produced in a thickness ranging from 1 to 5 mm. The preferable thickness is 2-3 mm. When the thickness of the connector, i.e., the length of the metal wire is 3 mm or less, the transmission loss can be 3 dB or less at a frequency of 6 GHz. The transmission loss preferably is 2 dB or less, and more preferably is 1 dB or less at the frequency of 6 GHz. Thus, a connector with low transmission loss in a high frequency region can be produced. Since the transmission loss of the conventional connector is 5-8 dB, the transmission loss of the connector of the present invention is reduced greatly.

A positioning hole or a positioning recess may be formed in a rubber portion of the connector. Thereby, the connector can be mounted to an electronic component automatically.

The metal wires arrayed in the thickness direction of the connector are magnetic metal wires, and preferable examples thereof include stainless steel thin wires SUS 304 and Ni thin wires. A diameter of the wire preferably is 10-50 μm. The surface preferably is plated. For example, preferably, the surface is nickel-plated as a base plating, and then gold-plated. This allows the wires to have high chemical stability and high anticorrosive properties.

The connector of the present invention can be used suitably for electrically connecting printed boards for a hard disk device (HDD). Specifically, since the thickness of the connector of the present invention can be reduced, the thickness of the HDD can be reduced, which results in the compact HDD.

Figure 1B:
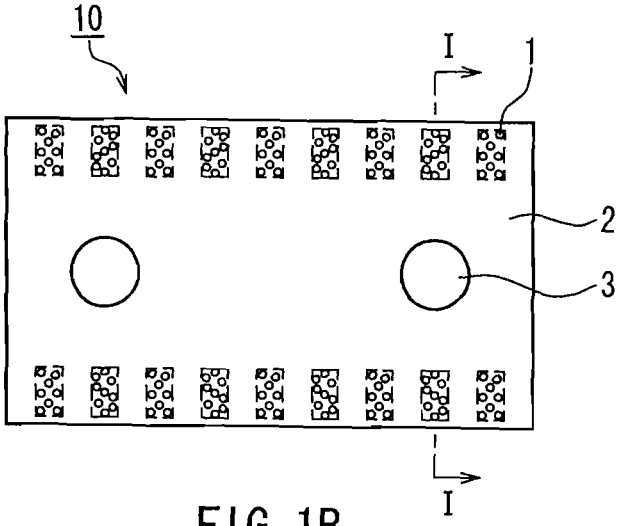
FIG. 1B is a plan view of the connector.
Figure 1C:
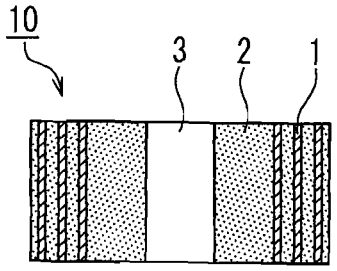
FIG. 1C is a cross-sectional view taken along a line I-I in FIG. 1B.

Next, the present invention will be described with reference to the drawings. FIG. 1A is a perspective view of a connector 10 in one example of the present invention, FIG. 1B is a plan view of the connector 10, and FIG. 1C is a cross-sectional view taken along a line I-I in FIG. 1B. In the connector 10, metal wires 1 are arrayed in the thickness direction and localized in predetermined positions. Although, in this example, the metal wires 1 are present at positions corresponding to 18 electrodes, the number of electrodes can be 18-22. An electrical insulating rubber 2 preferably is a flame-resistant urethane rubber. Positioning holes 3 or positioning recesses are formed in the connector 10. As for the positioning hole 3, the hole passes through the connector 10 in the thickness direction. As for a positioning recess, the recess does not pass therethrough. The positioning hole 3 or the positioning recess may be formed using a drill or a borer, or formed by melting with the contact of a hot metal rod. Dimensions of the connector can be determined arbitrarily. The exemplary connector of FIG. 1 has dimensions of 7.0 mm in length, 12.0 mm in width, and 3.0 mm in thickness. Each of the localized portions of the metal wires 1 has dimensions of 1.1 mm in length and 0.6 mm in width. When a diameter of the metal wire 1 is 12-25 μm, it is preferable to gather 10-100 metal wires at a portion corresponding to one electrode. A diameter of the positioning hole 3 preferably is 1-2 mm.

Figure 2A:
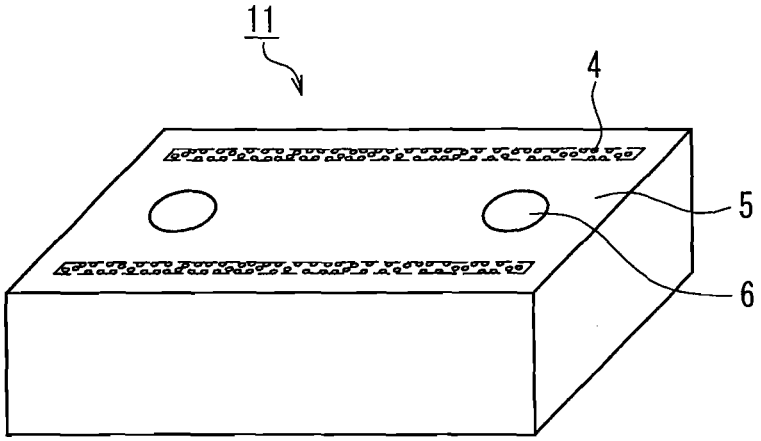
FIG. 2A is a perspective view of a connector in another example of the present invention.
Figure 2B:
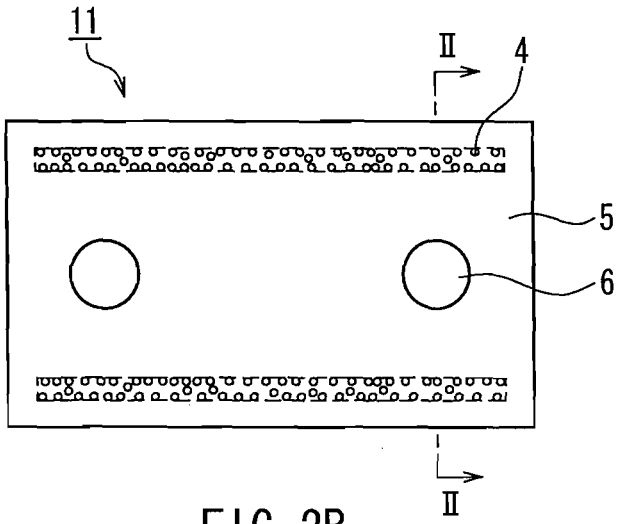
FIG. 2B is a plan view of the connector.
Figure 2C:
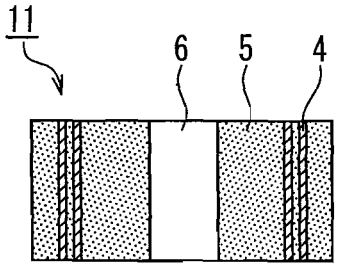
FIG. 2C is a cross-sectional view taken along a line II-II in FIG. 2B.

FIG. 2A is a perspective view of a connector 11 in another example of the present invention, FIG. 2B is a plan view of the connector 11, and FIG. 2C is a cross-sectional view taken along a line II-II in FIG. 2B. The connector 11 is different from the exemplary connector of FIG. 1 in that the localized portion of metal wires 4 is in a belt shape. Since the metal wires 4 of the present invention are present independently of each other in an electrical insulating rubber 5, there is no problem in arraying the wires in the belt shape. When the metal wires 4 are arrayed in the belt shape as in this example, it is possible to adapt to the change in the number of electrodes of printed circuit boards and of electronic components arranged on top and bottom of the connector 11. A reference numeral 6 indicates a positioning hole or a positioning recess.

Figure 3:
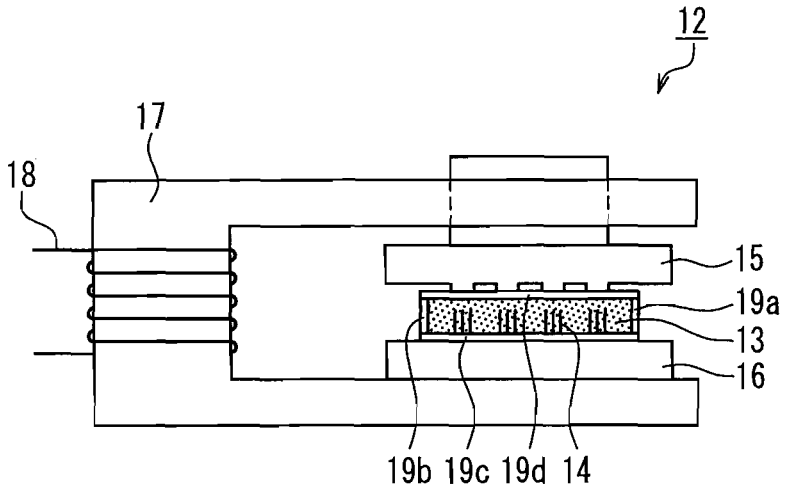
FIG. 3 is a schematic view of a connector producing apparatus in one example of the present invention.

FIG. 3 is a schematic view of a connector producing apparatus in one example of the present invention. The connector producing apparatus is a magnetic field forming apparatus 12 including an electromagnet 17, a winding 18, an upper die 15, and a lower die 16. A lower surface of the upper die 15 is formed in a concavo-convex shape for causing metal wires 14 to be arrayed vertically and localized. For producing the connector of the present invention, first, a plurality of the conductive metal wires 14 having a predetermined length are mixed into a liquid thermosetting electrical insulating rubber 13 material. Then, the liquid is poured into bakelite resin frames (19*a*, 19*b*) placed on a polyester (PET) film 19*c*, sandwiched by a PET film 19*d* from above so as to be formed into a preform having a uniform thickness, and then formed into a capsule sheet. Next, by applying a magnetic field from upper and lower surfaces of the thermosetting electrical insulating rubber 13 material in the thickness direction using the magnetic field forming apparatus 12, the wires are arrayed in the thickness direction and localized. Then, while applying a magnetic field, the liquid thermosetting urethane rubber material is cured by heating, and formed into a sheet by adjusting the thickness. The obtained sheet is punched into a predetermined size to form a desired product. The positioning hole or the positioning recess may be formed simultaneously at the time of the molding, or may be formed later. A viscosity of the liquid thermosetting electrical insulating rubber material preferably ranges from 100 to 1600 mPa·s. Further, a magnetic field intensity in the magnetic field forming apparatus preferably ranges from 40 to 300 mT.

Preferably, a wire array rubber connector is contained in an emboss tape or a tray, because this is convenient for automatically supplying the connector at the time of the incorporation into an electronic component.

EXAMPLES

Hereinafter, the present invention will be described further specifically by way of examples. Note that the present invention is not limited to the following examples.

(1) Flame Resistance

Evaluations were performed in accordance with the UL-94.

(2) Transmission Loss

A network analyzer produced by Agilent (Agilent E5071) and a coaxial cable (SUCOFLEX 104) were used. A specimen was sandwiched between two printed circuit boards. Signals were output from Port-1, and the signal intensity was measured by Port-2. The measurement frequency was set at 0-6 GHz (0-6000 MHz).

Example 1

(1) Thermosetting Urethane Rubber Material

As the liquid thermosetting urethane rubber material, "MU-204A/B" (trade name) produced by Pelnox, Ltd. was used. An initial mixing viscosity of the thermosetting urethane rubber material was 260 mPa·s.

(2) Conductive Metal Wire

A stainless steel wire SUS 304 having a length of 3.0 mm and a diameter of 12 μm was coated with 0.5 μm of nickel plating as a base plating, and then coated with 0.2 μm of gold plating.

(3) Preparation of Connector Material 120 g of the above liquid thermosetting urethane rubber material and 2.4 g of the above metal wires were sampled, mixed in a container, and defoamed. Then, as shown in FIG. 3, the liquid was poured into the bakelite resin frames (19*a*, 19*b*) placed on the polyester (PET) film 19*c*, sandwiched by the PET film 19*d* from above so as to be formed into a preform having a uniform thickness, and then formed into a capsule sheet.

(4) Formation of Magnetic Field

By applying a magnetic field from the upper and lower surfaces of the obtained capsule sheet in the thickness direction using the magnetic field forming apparatus 12, the wires were arrayed in the thickness direction and localized. A voltage of 37 V and a direct current of 2 A were applied to the winding 18, and a magnetic field of 120 mT was applied between the dies 15 and 16. While applying the magnetic field, the liquid thermosetting urethane rubber material was heated from room temperature to 50° C. in 0.5 hour, and maintained at the temperature for 2 hours to cure. The thickness of the urethane rubber material was adjusted in accordance with the progress of the curing to form a sheet. The final thickness was set at 3.0 mm. Next, the obtained sheet was punched into a length of 7 mm and a width of 12 mm. Then, as shown in FIG. 1, two positioning holes having a diameter of 1.5 mm were formed by a borer.

(5) Evaluation

Figure 5:
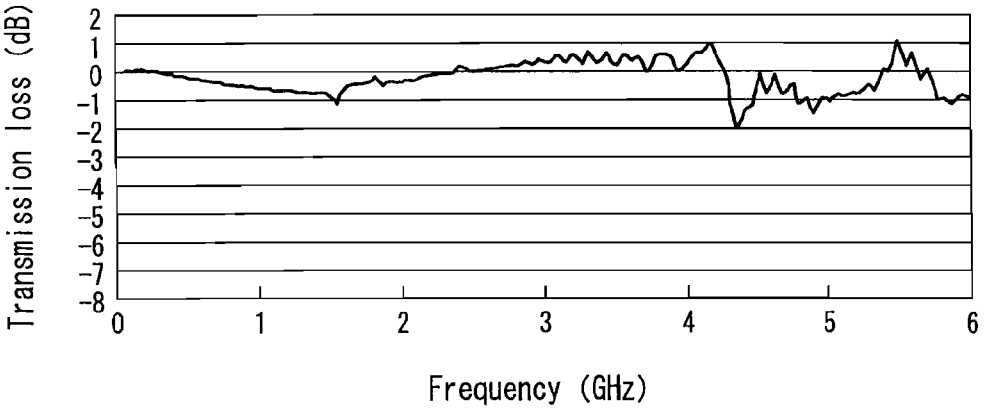
FIG. 5 is a graph showing data on a transmission loss of a connector in Example 1 of the present invention.

The obtained connector was satisfactory at 1A application (AC). The flame resistance was V-0 based on the UL-94 standard. The transmission loss was 1 dB at a frequency of 6 GHz. The data on the transmission loss is shown in FIG. 5. Characteristics of the urethane rubber itself were: color, transparent-semitransparent; hardness, 28 (shore A); tensile strength, 1.8 MPa; and volume resistivity, $6.0\times10^{13}$ Ω·cm.

Example 2

Figure 6:
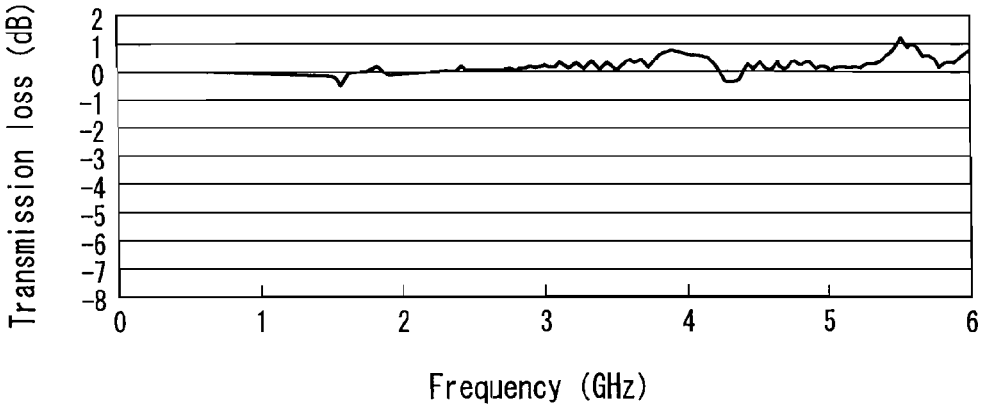
FIG. 6 is a graph showing data on a transmission loss of a connector in Example 2 of the present invention.

Example 2 was carried out in the same manner as Example 1 except that "XU-19662" (trade name) produced by Pelnox, Ltd. was used as the flame-resistant urethane rubber and the metal wire having a length of 2.0 mm was used. The obtained connector was satisfactory for 1A, 250 VAC. The flame resistance was V-0 based on the UL-94 standard. The transmission loss was 0 dB at the frequency of 6 GHz. The data on the transmission loss is shown in FIG. 6. Characteristics of the urethane rubber itself were: color, transparent-semitransparent; hardness, 35 (shore A); tensile strength, 1.8 MPa; and volume resistivity, $6.0\times10^{13}$ Ω·cm.

Example 3

Figure 7:
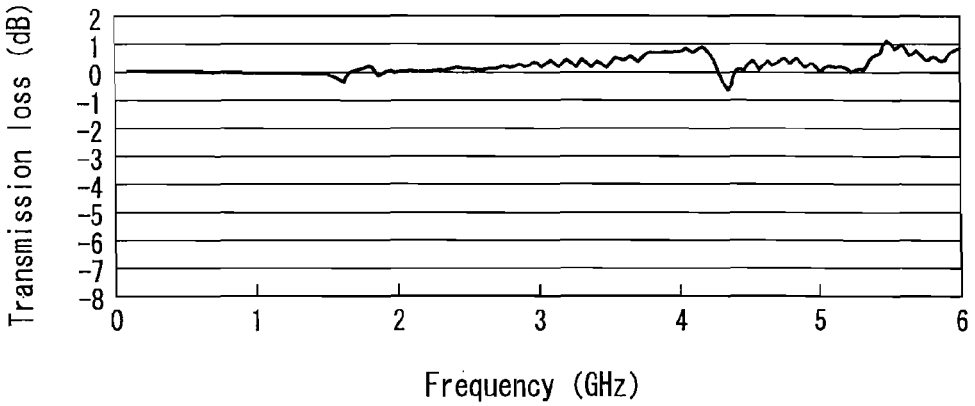
FIG. 7 is a graph showing data on a transmission loss of a connector in Example 3 of the present invention.

Example 3 was carried out in the same manner as Example 1 except that the metal wire having a length of 2.0 mm and a diameter of 25 μm was used. The obtained connector was satisfactory for 1A, 250 VAC. The flame resistance was V-0 based on the UL-94 standard. The transmission loss was 0 dB at the frequency of 6 GHz. The data on the transmission loss is shown in FIG. 7.

Comparative Example 1

Figure 4:
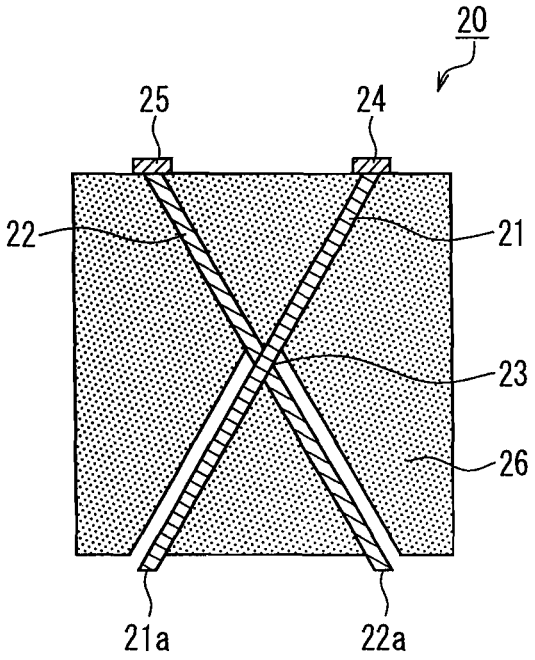
FIG. 4 is a cross-sectional view of a conventional wire connector.
Figure 8:
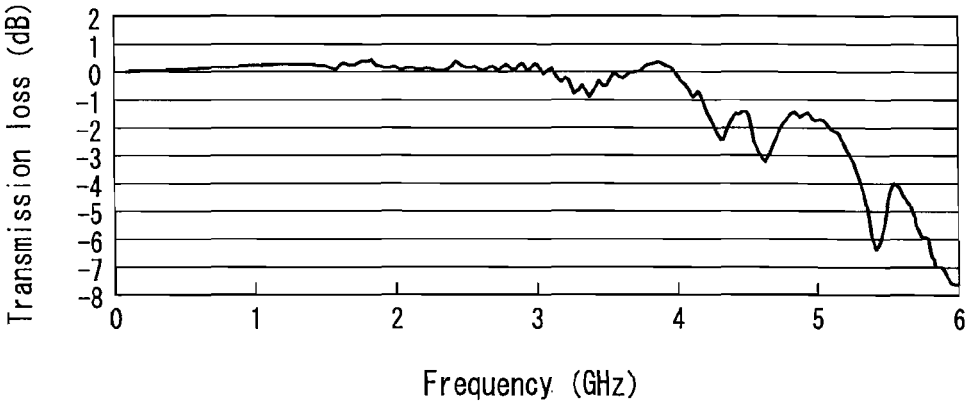
FIG. 8 is a graph showing data on a transmission loss of a connector in Comparative Example 1 of the present invention.

The flame resistance and the transmission loss were evaluated using a conventional hard disk connector 20 shown in FIG. 4. The conventional connector 20 shown in FIG. 4 has dimensions of 3.2 mm in thickness, 7 mm in length, and 12 mm in width. Wires 21 and 22 are fixed at a fixing portion 23, insulated from each other, and arrayed so as to cross each other. End portions 21*a*, 22*a* of the respective wires 21, 22 slightly protrude downward, and a clearance is created for allowing the wires to move upward at the time of press fitting. Reference numerals 24 and 25 indicate electrodes. A connector base 26 is formed of hard resin. The flame resistance of this conventional connector was V-0, and the transmission loss was 7.7 dB at the frequency of 6 GHz. The data on the transmission loss is shown in FIG. 8.

As shown in the above-described Examples 1-3 and Comparative Example 1, the connectors of Examples of the present invention were proved to have high flame resistance and low transmission loss in a high frequency region.

Example 4

Example 4 was carried out in the same manner as Example 1 except that the metal wire having a length of 3.15 mm and a diameter of 25 μm was used. The obtained connector was satisfactory at 1 A application (AC). The flame resistance was V-0 based on the UL-94 standard. The transmission loss was 1 dB at the frequency of 6 GHz, which was equal to or higher than those of Examples 1-3 but lower than that of the conventional connector. The flame resistance was satisfactory.

INDUSTRIAL APPLICABILITY

A conductive rubber component of the present invention is applicable to electronic components, such as a mobile telephone, a personal computer, an electronic dictionary, a navigator, a calculator, a portable game machine, a liquid crystal display device, a plasma display device, a video recorder and a sound recorder, other than hard disk devices.

DESCRIPTION OF REFERENCE NUMERALS

1, 4, 14 metal wire
2, 5 electrical insulating rubber
3, 6 positioning hole or positioning recess
10, 11 connector
12 magnetic field forming apparatus
13 liquid thermosetting urethane rubber material
15 upper die
16 lower die
17 electromagnet
18 winding
19*a*-19*b* bakelite resin frame
19*c*-19*d* polyester film

The invention claimed is:

1. A wire array rubber connector, comprising:

an electrical insulating rubber; and a plurality of conductive metal wires that are arrayed in a thickness direction of the electrical insulating rubber so as to pass through front and back surfaces of the electrical insulating rubber, and localized so as to be electrically connectable to electrical terminals that are disposed at predetermined positions on the front and back surfaces of the electrical insulating rubber, wherein the electrical insulating rubber is a flame-resistant rubber achieving V-0 based on a UL-94 standard, and the flame-resistant rubber is a thermosetting flame-resistant urethane rubber; and a positioning hole or a positioning recess is formed in a rubber portion of the wire array rubber connector.

2. The wire array rubber connector according to claim 1, wherein a transmission loss of the wire array rubber connector is 3 dB or less at a frequency of 6 GHz.

3. The wire array rubber connector according to claim 1, wherein the wire array rubber connector is a connector for electrically connecting printed boards for a hard disk device.

4. The wire array rubber connector according to claim 1, wherein the wire array rubber connector is contained in an emboss tape or a tray.

5. A method for producing a wire array rubber connector, comprising:

mixing a plurality of conductive metal wires having a predetermined length into a liquid thermosetting electrical insulating rubber material;

applying a magnetic field from a thickness direction of the rubber material using an electromagnet that is patterned in a predetermined pattern so that the conductive metal wires are arrayed in the thickness direction to have portions that are exposed at front and back surfaces of the rubber material for each of the conductive metal wires and localized;

curing the rubber material by heating to produce an electrical insulating rubber, wherein, the electrical insulating rubber is a flame-resistant rubber achieving V-0 based on a UL-94 standard, and the flame-resistant rubber is a thermosetting flame-resistant urethane rubber; and forming a positioning hole or a positioning recess in a rubber portion of the wire array rubber connector.

6. The method for producing the wire array rubber connector according to claim 5, wherein a viscosity of the liquid thermosetting electrical insulating rubber material ranges from 100 to 1600 mPa·s.

7. The method for producing the wire array rubber connector according to claim 5, wherein a magnetic field intensity at the time of applying the magnetic field for arraying the conductive metal wires in the thickness direction ranges from 40 to 300 mT.

8. The method for producing the wire array rubber connector according to claim 5, wherein a transmission loss of the wire array rubber connector is 3 dB or less at a frequency of 6 GHz.

9. The method for producing the wire array rubber connector according to claim 5, wherein the wire array rubber connector is contained in an emboss tape or a tray.

* * * * *